US007946284B2

(12) United States Patent
DeLaquil et al.

(10) Patent No.: US 7,946,284 B2
(45) Date of Patent: May 24, 2011

(54) METHOD AND APPARATUS FOR COVERTLY MARKING TARGETS

(75) Inventors: Matthew P. DeLaquil, Rockwall, TX (US); Thomas J. Galli, Rockwall, TX (US)

(73) Assignee: L3 Communications Integrated Systems, L.P., Greenville, TX (US)

( * ) Notice: Subject to any disclaimer, the term of this patent is extended or adjusted under 35 U.S.C. 154(b) by 163 days.

(21) Appl. No.: 12/498,814

(22) Filed: Jul. 7, 2009

(65) Prior Publication Data

US 2011/0007300 A1 Jan. 13, 2011

(51) Int. Cl.
*F41B 11/00* (2006.01)

(52) U.S. Cl. ..... 124/72

(58) Field of Classification Search ..... 124/60, 124/71, 72; 42/1.09, 1.11
See application file for complete search history.

(56) References Cited

U.S. PATENT DOCUMENTS

| | | | | |
|---|---|---|---|---|
| 1,073,312 | A * | 9/1913 | Woods | 42/1.09 |
| 3,109,253 | A * | 11/1963 | Eig | 42/1.09 |
| 3,589,062 | A * | 6/1971 | Desmond et al. | 446/405 |
| 5,511,711 | A * | 4/1996 | Kunz | 224/539 |
| 5,988,450 | A * | 11/1999 | Cassarino | 222/192 |
| 6,598,563 | B2 * | 7/2003 | Kim et al. | 119/720 |
| 6,778,811 | B1 * | 8/2004 | Grove | 455/66.1 |
| 7,187,291 | B2 * | 3/2007 | Crist et al. | 340/573.3 |
| 2007/0181116 | A1 * | 8/2007 | Wei | 124/74 |

* cited by examiner

*Primary Examiner* — Troy Chambers
(74) *Attorney, Agent, or Firm* — Hovey Williams LLP

(57) ABSTRACT

An apparatus for covertly marking a target includes a housing sized and configured to simulate a portable electronic device; a reservoir positioned in the housing for holding a quantity of miniature markers; and a dispersing mechanism positioned in or on the housing for dispersing the markers onto the target.

21 Claims, 3 Drawing Sheets

METHOD AND APPARATUS FOR COVERTLY MARKING TARGETS

BACKGROUND OF THE INVENTION

1. Field of the Invention

The present invention relates to methods and devices for covertly marking targets. More particularly, embodiments of the invention relate to an apparatus which can be used to covertly apply quantum dots or other miniature markers to a person or other target so that the target can be tracked or otherwise monitored.

2. Description of the Related Art

Military personnel, FBI agents, CIA agents, law enforcement officers, and others involved in military, police, anti-terrorism, surveillance, security or other similar operations often desire to track or otherwise monitor individuals, vehicles, or other targets for surveillance and related purposes. To assist in such tracking or monitoring, it is known to affix a tracking device to the target, but when the target is a person, this is difficult to do without alerting the person.

SUMMARY OF THE INVENTION

The present invention solves the above-described problem and offers a distinct advance in the art of target tracking and monitoring by providing a method and apparatus for covertly marking a target.

One embodiment of the invention is an apparatus comprising a housing, a reservoir positioned in the housing for holding a quantity of quantum dots or other miniature markers, and a dispersing mechanism positioned in or on the housing for dispersing the markers onto the target. Advantageously, the housing is sized and configured to simulate a portable electronic device such as a mobile phone so that an agent or other person may covertly and discreetly mark a target while pretending to use the apparatus for its apparent purpose.

In one embodiment, the dispersing mechanism comprises a nozzle positioned on the housing for aiming the markers toward the target, a propellant for propelling the markers out the nozzle, and a trigger for releasing the markers from the reservoir and activating the propellant. The propellant may comprise a canister of compressed gas, a puff of air generated by the trigger, a laser generator, a radio frequency generator, a sonic generator, an electromagnetic generator, or any other mechanism that can propel or convey the markers to the target. The trigger may be an electrical, mechanical, or electromechanical switch or button that has the appearance of a conventional switch or button on a mobile phone or other electronic device.

In another embodiment of the invention, the apparatus includes a reservoir for holding markers and a dispensing mechanism for dispensing the markers as described above, and further includes conventional wireless communication equipment. This embodiment permits the agent or other person to communicate with a remote command station or other surveillance personnel while marking a target.

Once the markers have been applied to the target, the markers and therefore the target can be easily tracked with a detector such as a quantum dot infrared photodetector.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
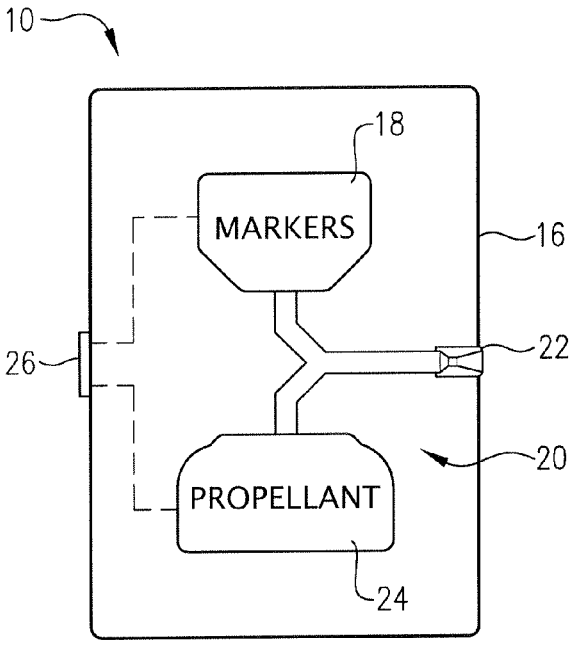
FIG. 1 is a schematic diagram of an apparatus constructed in accordance with an embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 2:
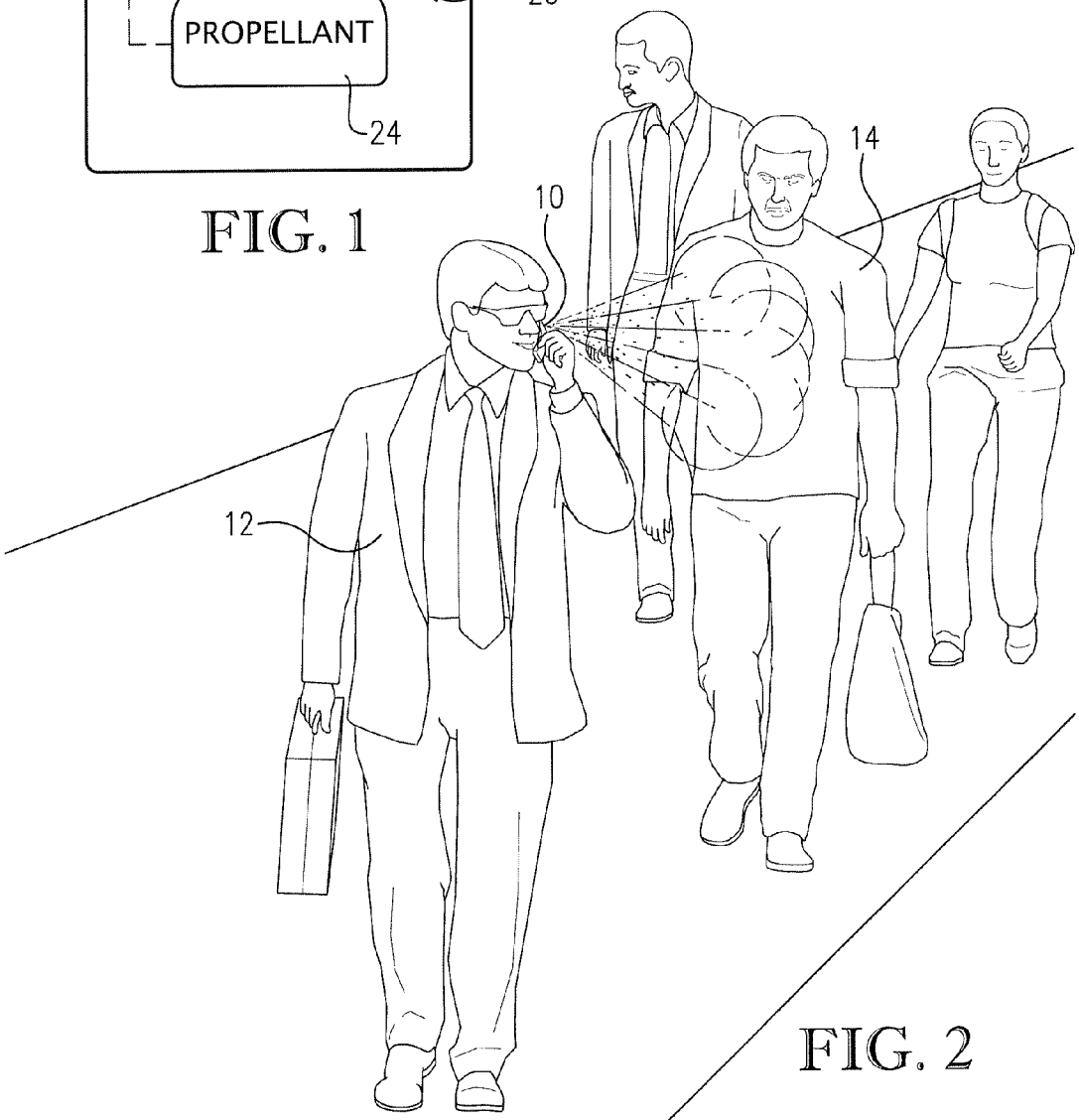
FIG. 2 illustrates an agent or other person using the apparatus of FIG. 1 to mark a target.
Figure 3:
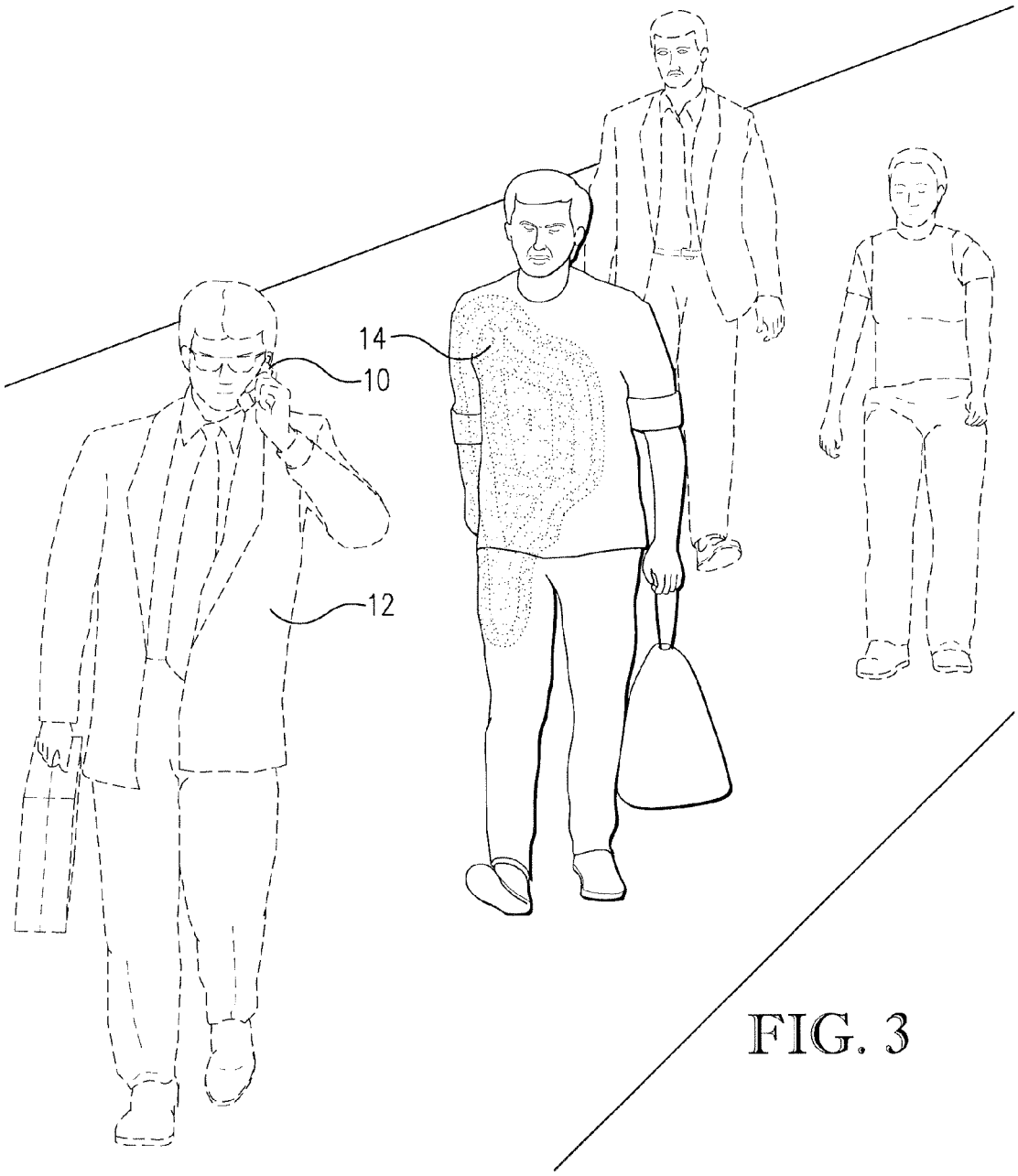
FIG. 3 illustrates how a marked target may appear when viewed with a photodetector.

FIG. 1 illustrates an apparatus 10 constructed in accordance with one embodiment of the invention. As illustrated in FIGS. 2 and 3, the apparatus may be used by an agent 12 or any other person for marking a target 14 such as a person, vehicle, or any other object so that the target 14 can be more easily tracked and/or monitored. The embodiment of the apparatus 10 shown in FIG. 1 broadly comprises a housing 16, a reservoir 18 positioned in the housing for holding a quantity of quantum dots or other miniature markers, and a dispersing mechanism 20 positioned in or on the housing for dispersing the markers onto the target 14.

In more detail, the housing 16 is preferably handheld or otherwise portable and may be constructed from a suitable lightweight and impact-resistant material such as, for example, plastic, nylon, aluminum, or any combination thereof. The housing may include one or more appropriate gaskets or seals to make it substantially waterproof or resistant. The housing may take any suitable shape or size, and its particular size, weight and configuration may be changed without departing from the scope of the present invention.

One embodiment of the housing 16 is sized and configured to simulate a portable electronic device such as a mobile phone, MP3 player, personal digital assistant, or personal navigation device so that the agent 12 or other person may covertly and discreetly mark the target 14 while pretending to use the apparatus for its apparent purpose. In a particularly preferred embodiment, the housing 16 simulates a mobile phone so that it can be discretely held and used while at eye level as shown in FIG. 2. This permits the agent 12 to more accurately aim the apparatus 10 at the target 14 without alerting the target.

The reservoir 18 is preferably positioned within the housing 16 and may be a canister, tank, tube, or any other device capable of holding a quantity of the markers. The reservoir 18 may be loaded with a supply of the markers during manufacture of the apparatus 10 and then sealed or may include a refilling port or valve so that markers can be loaded or reloaded into the apparatus after manufacture.

The markers may be quantum dots, metamaterials, microelectromechanical systems (MEMs), nanoelectromechanical systems (NEMs), or any other miniaturized marking device that cannot be easily seen with the naked eye. For example, the markers may be quantum dots configured to fluoresce in an infrared spectrum so that they can be detected with a quantum dot infrared photodetector. In one embodiment, the quantum dots have a particle size between 10 nm and 100 nm, and in another embodiment between 10 nm and 50 nm. The particle size of the quantum dots is preferably selected so that they fluoresce light in a particular wavelength detectable by a particular infrared detector. Differently sized quantum dots may be used for different surveillance operations to aid in target identification. For example, quantum dots having a particle size of 10 nm may be selected and applied to one target so they can be detected by a detector tuned to one wavelength range, and quantum dots having a particle size of 50 nm may be selected and applied to another target so they can be detected by a detector tuned to another wavelength range. This permits a surveillance team to differentiate between multiple marked targets.

One embodiment of the dispersing mechanism 20 may comprise a nozzle 22 positioned on the housing for aiming the markers toward the target 14, a propellant 24 for propelling the markers out the nozzle 22, and a trigger 26 for releasing the markers from the reservoir 18 and activating the propellant 24. The nozzle may be any device capable of aiming the markers toward a target. The nozzle may be positioned anywhere on the housing but is preferably positioned on the back face of the housing (opposite the side held to the agent's face as depicted in FIG. 2) so that the nozzle can be easily aimed at the target. The particular dispersion pattern of the nozzle may be selected depending on the desired area to be marked on the target and the estimated distance between the agent and the target when the markers are applied.

The propellant 24 may comprise a canister of compressed gas, a puff of air generated by the trigger 26, a laser generator, a radio frequency generator, a sonic generator, an electromagnetic generator, or any other mechanism that can propel or convey the markers to the target. If the propellant is a canister of compressed gas, it may be removable and configured for replacement with a new canister once exhausted.

The trigger 26 may be any electrical, mechanical, or electromechanical device capable of releasing markers from the reservoir 18 and activating the propellant 24. In one embodiment, the trigger 26 is an electrical switch that, when activated, operates a valve or other mechanism on the reservoir 18 to release a quantity of the markers, and operates a valve or other mechanism on the propellant to eject the released markers out of the nozzle 22.

Figure 4:
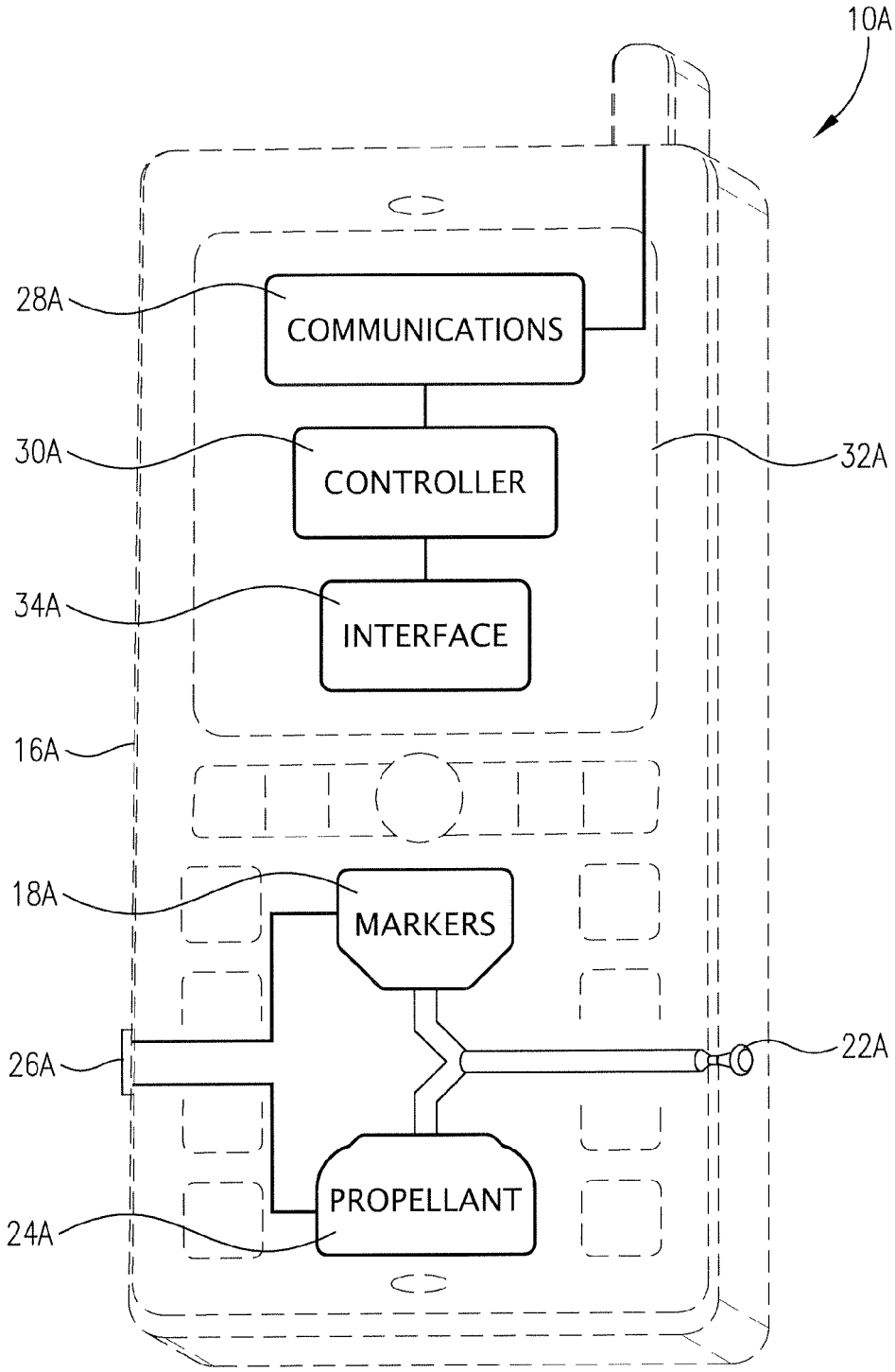
FIG. 4 is a schematic diagram of an apparatus constructed in accordance with another embodiment of the invention.

FIG. 4 illustrates an apparatus 10A constructed in accordance with another embodiment of the invention. The apparatus 10A includes a housing 16A, a reservoir 18A for holding markers, and a nozzle 22A, propellant 24A, and trigger 26A for dispensing the markers as described above, and further includes conventional wireless communication equipment that permits the agent 12 or other person using the apparatus 10A to communicate with a remote command station or other surveillance personnel while marking the target 14. Specifically, the apparatus 10A may include a communications component 28A, a controller 30A, a display 32A, an interface 34A, and other components.

The communications component 28A enables the apparatus 10A to communicate with other electronic devices through a communication network, such as the Internet, a local area network, a wide area network, an ad hoc or peer to peer network, or a direct connection such as a USB, Firewire, or Bluetooth™ connection, etc. The communications component 28A may communicate utilizing wireless data transfer methods such as WiFi (802.11), Wi-Max, Bluetooth™, ANT®, ultra-wideband, infrared, cellular telephony, radio frequency, etc.

The communications component 28A may make and receive any communications including incoming and outgoing phone calls, text messages, instant message, voicemail messages, e-mail message, missed phone calls, and any other known communications. In one embodiment, the communications component 28A is a cellular transceiver for transmitting and receiving communications over a cellular phone network such as those operated by Sprint®, AT&T®, Verizon®, and other companies. The cellular phone network may operate with GSM (Global System for Mobile communications), CDMA (Code Division Multiple Access), or any other known standards.

The controller 30A may include any number of processors, controllers, integrated circuits, programmable logic devices, or other computing devices and resident or external memory for storing data and other information accessed and/or generated by the apparatus 10A. The controller 30A is preferably coupled with the communications component 28A, the display 32A, the user interface 34A, and other components through wired or wireless connections, such as a data bus, to enable information to be exchanged between the various components.

The controller 30A may implement a computer program and/or code segments to perform some of the functions described herein. The computer program may comprise an ordered listing of executable instructions for implementing logical functions in the computing device. The computer program can be embodied in any computer-readable medium for use by or in connection with an instruction execution system, apparatus, or device, and execute the instructions. In the context of this application, a "computer-readable medium" can be any means that can contain, store, communicate, propagate or transport the program for use by or in connection with the instruction execution system, apparatus, or device. The computer-readable medium can be, for example, but not limited to, an electronic, magnetic, optical, electromagnetic, infrared, or semi-conductor system, apparatus, device, or propagation medium. More specific, although not inclusive, examples of the computer-readable medium would include the following: an electrical connection having one or more wires, a random access memory (RAM), a read-only memory (ROM), an erasable, programmable, read-only memory (EPROM or Flash memory), a portable computer diskette, and a portable compact disk read-only memory (CDROM).

The display 32A is coupled with the controller 30A and is operable to display various information. The display 32A may comprise conventional black and white, monochrome, or color display elements including, but not limited to, Liquid Crystal Display (LCD), Thin Film Transistor (TFT) LCD, Polymer Light Emitting Diode (PLED), Organic Light Emitting Diode (OLED) and/or plasma display devices. Preferably, the display 32A is of sufficient size to enable the user to easily view it while outdoors. The display 32A may be integrated with the user interface 34A, such as in embodiments where the display 32A is a touch-screen display to enable the user to interact with it by touching or pointing at display areas to provide information to the apparatus 10A.

The apparatus 10A also may include memory that is integral with the controller 30A, stand-alone memory, or a combination of both, The memory may include, for example, removable and non-removable memory elements such as RAM, ROM, Flash, magnetic, optical, USB memory devices, and/or other conventional memory elements. The memory may store various data associated with operation of the apparatus, such as the computer program and code segments mentioned above, or other data for instructing the controller and other device elements to perform the steps described herein.

The user interface 34A permits a user to operate the apparatus 10A and is generally associated with the housing 16A, such as by physical connection through wires, etc, or wirelessly utilizing various wireless protocols. However, the user interface 34A need not be physically coupled with the housing.

The user interface 34A may comprise one or more functionable inputs such as buttons, switches, scroll wheels, a touch screen associated with the display, voice recognition elements such as a microphone, pointing devices such as mice, touchpads, trackballs, styluses, a camera such as a digital or film still or video camera, combinations thereof, etc. Further, the user interface 34A may comprise wired or wireless data transfer elements such as removable memory including the memory, data transceivers, etc, to enable the user and other devices or parties to remotely interface with the device. The apparatus 10A may also include a speaker for providing audible instructions and feedback.

The apparatus 10A may also include an internal power source that provides electrical power to the other components of the apparatus. The power source may comprise conventional power supply elements, such as batteries, battery packs, etc. The power source may also comprise power conduits, connectors, and receptacles operable to receive batteries, battery connectors, or power cables. For example, the power source may include both a battery to enable portable operation and a power input for receiving power from an external source such an automobile.

As shown in FIGS. 2 and 3, the apparatus 10 or apparatus 10A may be used by an agent 12 or other person to mark a target 14 by dispersing a quantity of the markers onto the target. Once the markers have been applied to the target, the markers and therefore the target fluoresce or otherwise stand out from non-marked objects as depicted in FIG. 3. This permits the marked target to be easily tracked with a detector such as a quantum dot infrared photodetector.

Although the invention has been described with reference to the embodiments illustrated in the attached drawing figures, it is noted that equivalents may be employed and substitutions made herein without departing from the scope of the invention as recited in the claims. For example, the specific embodiments of the apparatus 10 and apparatus 10A and their components illustrated and described herein are merely examples of devices and components that may be used to implement the present invention and may be replaced with other devices and components without departing from the scope of the present invention.

Having thus described various embodiments of the invention, what is claimed as new and desired to be protected by Letters Patent includes the following:

1. An apparatus for marking a target, the apparatus comprising:

a housing sized and configured to simulate a portable electronic device;

a reservoir positioned in the housing for holding a quantity of miniature markers; and a dispersing mechanism positioned in or on the housing for dispersing the markers out of the housing and onto the target.

2. The apparatus as set forth in claim 1, wherein the housing is sized and configured to simulate a mobile phone.

3. The apparatus as set forth in claim 1, wherein the housing is sized and configured to simulate an MP3 player, personal digital assistant, or personal navigation device.

4. The apparatus as set forth in claim 1, wherein the dispersing mechanism comprises a nozzle positioned on the housing for aiming the markers toward the target, a propellant for propelling the markers from the reservoir and out the nozzle, and a trigger for releasing the markers from the reservoir and activating the propellant.

5. The apparatus as set forth in claim 4, wherein the propellant comprises a canister of compressed gas.

6. The apparatus as set forth in claim 4, wherein the propellant comprises a device for generating a puff of air.

7. The apparatus as set forth in claim 4, wherein the propellant comprises a laser generator, a radio frequency generator, a sonic generator, or an electromagnetic generator positioned in the housing.

8. An apparatus for marking a target, the apparatus comprising:

a housing sized and configured to simulate a mobile phone; a quantity of miniature markers contained within the housing; a nozzle positioned on the housing; a propellant for propelling the markers through the nozzle and out of the housing; and a trigger for activating the propellant.

9. The apparatus as set forth in claim 8, wherein the miniature markers comprise quantum dots.

10. The apparatus as set forth in claim 9, wherein the quantum dots are configured to fluoresce in an infrared spectrum.

11. The apparatus as set forth in claim 9, wherein each of the quantum dots has a particle size between 10 nm and 100 nm.

12. The apparatus as set forth in claim 11, wherein each of the quantum dots has a particle size between 10 nm and 50 nm.

13. The apparatus as set forth in claim 8, wherein the miniature markers comprise metamaterials.

14. The apparatus as set forth in claim 8, wherein the miniature markers comprise microelectromechanical systems.

15. The apparatus as set forth in claim 8, wherein the miniature markers comprise nanoelectromechanical systems.

16. The apparatus as set forth in claim 8, wherein the propellant comprises a canister of compressed gas.

17. The apparatus as set forth in claim 8, wherein the propellant comprises a device for generating a puff of air.

18. The apparatus as set forth in claim 8, wherein the propellant comprises a laser generator, a radio frequency generator, a sonic generator, or an electromagnetic generator.

19. A method for marking and tracking a target, the method comprising:

storing a quantity of miniature markers within a housing sized and configured to simulate a mobile phone; dispersing the markers out of the housing and onto the target with a dispersing mechanism contained in or on the housing; and tracking the target with an infrared detector capable of detecting presence of the markers on the target.

20. The method as set forth in claim 19, further including the step of sizing the markers to select an optical signature of the markers detectable by an infrared photo detector.

21. An apparatus for marking a target, the apparatus comprising:

a housing sized and configured to simulate a portable electronic device;

a wireless communication component positioned in the housing for transmitting and receiving wireless communications;

a quantity of miniature markers contained within the housing;

a nozzle positioned on the housing;

a propellant for propelling the markers the nozzle and out of the housing; and a trigger for activating the propellant.

* * * * *